United States Patent [19]

Whitehorn

[11] Patent Number: 4,638,849

[45] Date of Patent: Jan. 27, 1987

[54] NOZZLE ASSEMBLY FOR DIE CASTING APPARATUS

[75] Inventor: Sydney H. Whitehorn, Birmingham, Mich.

[73] Assignee: VSI Corporation, Pasadena, Calif.

[21] Appl. No.: 779,984

[22] Filed: Aug. 25, 1985

[51] Int. Cl.[4] ..... B22D 17/02

[52] U.S. Cl. ..... 164/311; 164/154

[58] Field of Search ..... 164/154, 311, 303, 310, 164/309; 222/593, 592, 591; 219/240, 424, 425, 483, 551, 200, 201, 213, 214, 241, 281, 282, 300, 301, 535, 298; 156/91; 428/621, 632; 277/22, 95, 235 R, 233

[56] References Cited

U.S. PATENT DOCUMENTS 3,009,218 11/1961 Rearwin ..... 164/309

3,789,188 1/1974 Rudbarg ..... 219/298

4,516,782 5/1985 Usher ..... 277/233

FOREIGN PATENT DOCUMENTS 57-62848 4/1982 Japan ..... 222/593

*Primary Examiner*—Nicholas P. Godici

*Assistant Examiner*—G. M. Reid

*Attorney, Agent, or Firm*—Gerald E. McGlynn, Jr.

[57] ABSTRACT

A nozzle assembly for delivering molten metal to a die casting mold comprises a relatively large diameter cylindrical main body section, a relatively small diameter inlet tip section, and a relatively small diameter outlet tip section. Separate heater elements are wrapped around the respective sections and a controller functions to maintain set point body temperatures in each nozzle section in response to signals received from thermocouples separately associated with each nozzle section.

6 Claims, 4 Drawing Figures

NOZZLE ASSEMBLY FOR DIE CASTING APPARATUS

BACKGROUND OF THE INVENTION

This invention relates to a nozzle assembly for conducting molten metal to a die casting mold.

In die casting, a nozzle assembly is typically employed to conduct the molten metal under pressure from a molten metal source to a mold or die. To avoid solidification of the metal in the nozzle assembly and ensure proper filling of the mold, it is usual practice to heat the nozzle assembly by a flame. Flame heating, while satisfactory in some applications, embodies several disadvantages. Specifically, flame heating tends to be wasteful of energy, is not amenable to precise temperature control, and tends to promote tempering and resultant erosion of the metal lining the bore of the nozzle and a consequent short nozzle service life. Whereas attempts have been made to heat the nozzle assembly in a die casting apparatus by the use of an electrical resistance heating element, such arrangements have been generally unsatisfactory due to the inability to precisely control the temperature within the nozzle assembly.

Prior art nozzle assemblies have also suffered from rapid wear and distortion of the nozzle at the outlet or tip of the nozzle where the nozzle makes sealing contact with a spherical seat at the inlet of the mold sprue.

Prior art nozzle assembly designs have also not satisfied problems associated with freeze ups occurring at the outlet tip of the nozzle.

SUMMARY OF THE INVENTION

The nozzle assembly of the present invention provides precise nozzle temperature control with a resultant improvement in the mold filling performance and a resultant improvement in the useful life of the nozzle. The invention nozzle assembly also facilitates selective nozzle repair and reduces nozzle inventory requirements.

According to an important feature of the invention nozzle assembly, the nozzle includes multiple sections arranged end to end and defining a continuous central axial through passage; a separate electrically energized heating element is wrapped around each nozzle section with the combined heating elements extending for substantially the entire axial length of the nozzle; and control means are provided which are operative to sense the temperature of the nozzle in each section and selectively and respectively energize the heating elements to maintain separate predetermined temperatures in each of the nozzle sections. In the disclosed embodiment, the control means comprises a settable closed loop controller operative to maintain separate and respective set point temperatures for each section of the nozzle.

According to a further feature of the invention, the nozzle includes a central main body section, an inlet tip section at the inlet end of the main body section, and an outlet tip section at the outlet end of the main body section; the sections are arranged end to end with through central bores in each section aligning to form a continuous nozzle through passage; and a separately controlled resistive electrical heating element is wrapped around each nozzle section to provide separate temperature control for each nozzle section.

According to yet another feature of the invention, the diameter of the inlet and outlet nozzle tip sections is significantly smaller than the diameter of the main body nozzle section to provide the required nozzle mass and strength and yet allow the nozzle tips to readily access the closely confined and/or uniquely shaped coacting seat areas on the die inlet and the gooseneck outlet.

According to yet another feature of the invention, the outlet end of the outlet nozzle tip is shaped to provide a spherically rounded annular seating surface around the outlet of the tip section bore conforming to a nozzle seating surface at the die inlet, and a flexible annular insulator seal is secured to the outlet end of the tip section and conforms to the rounded annular seating surface to provide an insulator seal between the tip outlet and the die inlet. In the disclosed embodiment, the insulator seal is formed of a composite material including a central aluminum mesh layer sandwiched between layers of heat insulative ceramic material and including an adhesive backing on one face for securement to the outlet end of the nozzle outlet tip section.

DETAILED DESCRIPTION OF THE PREFERRED EMBODIMENT

Figure 1:
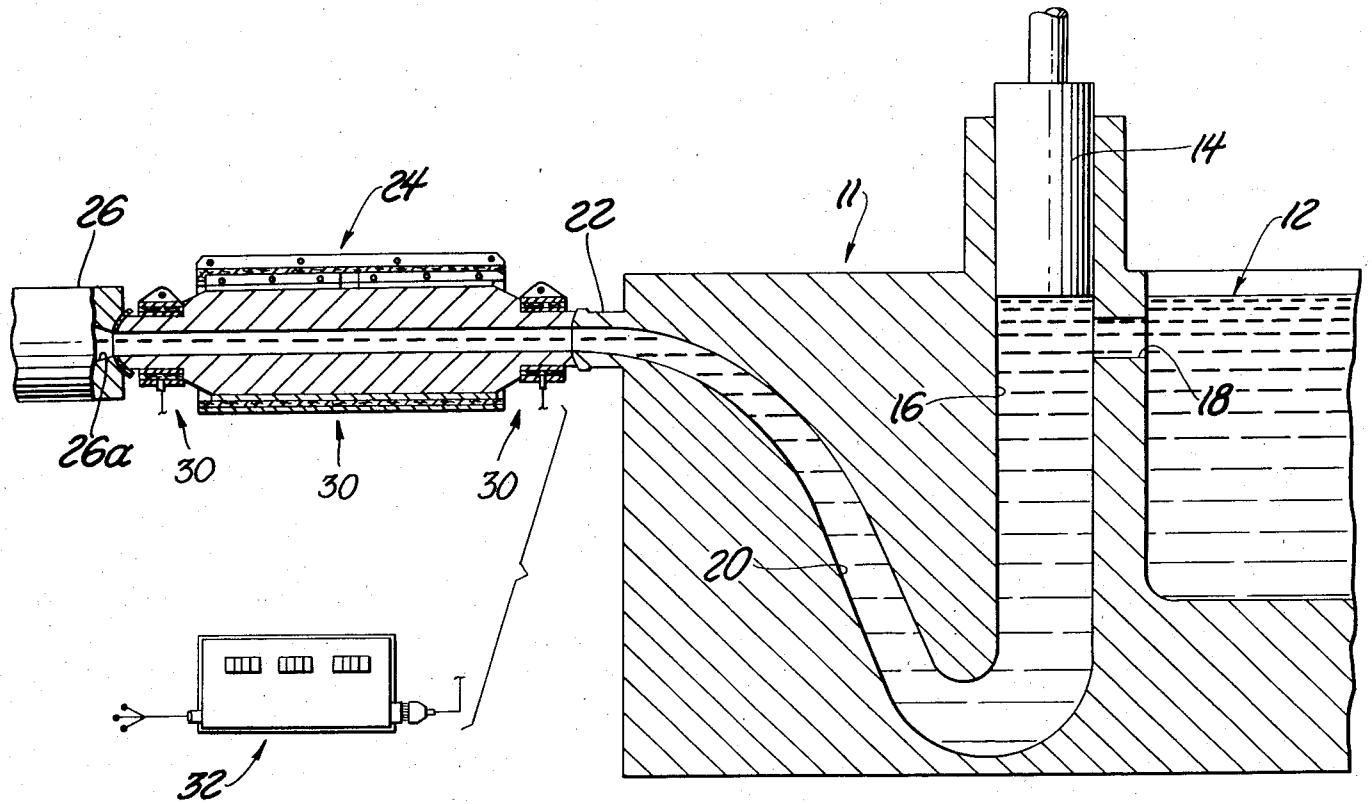
FIG. 1 is a somewhat schematic cross sectional view of a die casting apparatus employing the invention nozzle assembly.
Figure 2:
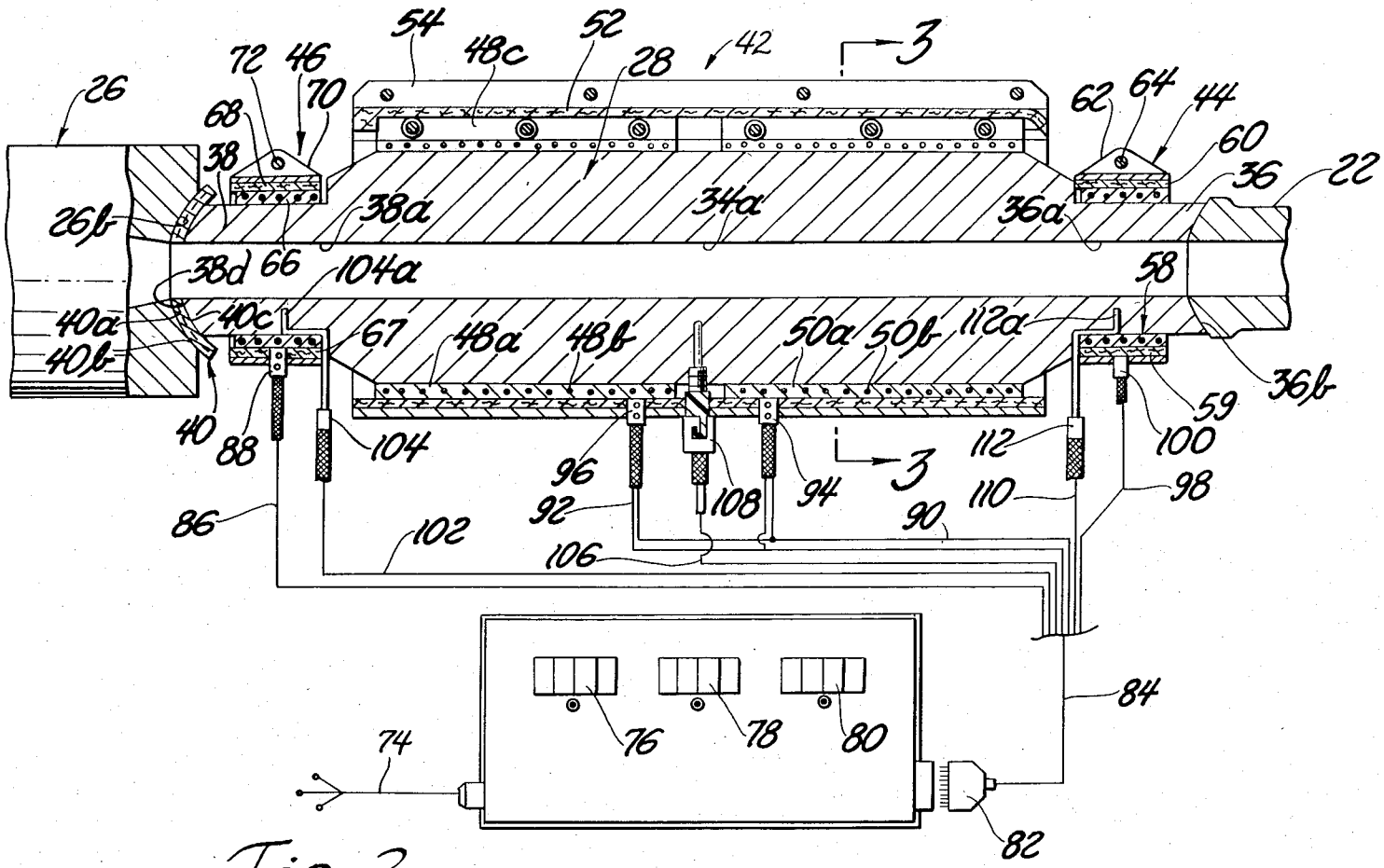
FIG. 2 is a detailed cross sectional view on an enlarged scale of the nozzle assembly seen schematically in FIG. 1.
Figure 3:
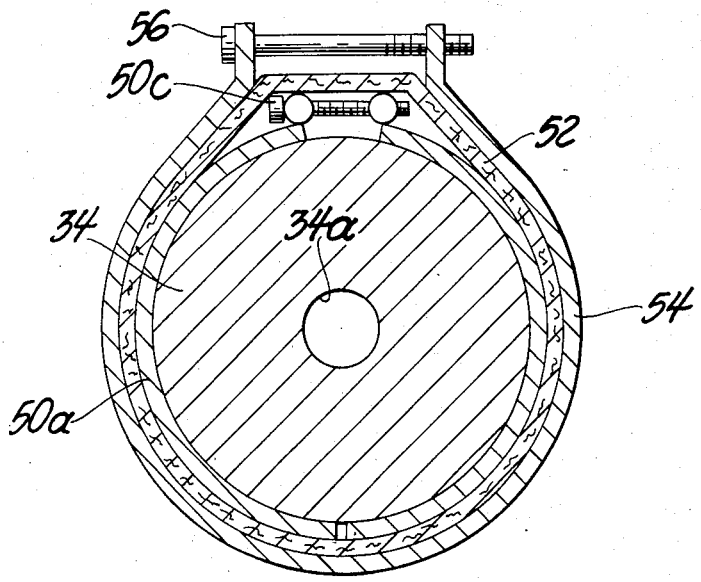
FIG. 3 is a cross-sectional view taken on line 3—3 of FIG. 2.

The die casting apparatus as seen schematically in FIG. 1 includes a furnace 11 including a container 12 for containing the molten metal; a pump or plunger 14 mounted for vertical pumping or charging movement in a vertical passage 16 communicating with chamber 12 via a port 18; a gooseneck passage 20 extending upwardly in curvilinear fashion from the bottom of vertical passage 16 to an upward discharge end 22; and a nozzle assembly 24 for receiving the molten metal output from gooseneck passage 22 and conveying the metal in molten form to the inlet of the sprue bushing 26 of the die casting machine. In operation, plunger 14 is actuated downwardly to force a charge of molten metal downwardly in passage 16, thence upwardly in gooseneck passage 20, and thence through nozzle assembly 24 to the die casting machine through inlet or sprue passage 26*a*.

The invention nozzle assembly 24 includes a nozzle 28, heater means 30, and a closed loop controller 32.

Nozzle 28 includes a main body section 34; an inlet tip section 36; and an outlet tip section 38. Main body nozzle section 34 is cylindrical, of a relatively large diameter, and includes a central through axial bore 34*a*.

Inlet tip section 36 is cylindrical, of a relatively small diameter, and includes a through axial bore 36*a* coaxial with bore 34*a*. The inlet end of section 36 is concavely configured at 36*b* to seatingly and sealingly receive the concave outlet face of gooseneck discharge 22. Alternatively, surface 36*b* may be convex to seatingly and sealingly receive a concave outlet face on gooseneck discharge 22.

Outlet tip section 38 is cylindrical, of a relatively small diameter generally corresponding to, or slightly less than, the diameter of inlet section 34, and includes a through axial bore 38*a* coaxial with bores 34*a* and 36*a*.

The discharge or outlet end of outlet tip section 38 is spherically rounded to provide an annular convex spherical seating surface 38*d* around the outlet of tip central bore 38*a*. The radius of convex spherical surface 38*d* corresponds to the radius of the concave spherical seat 26*b* at the inlet of sprue passage 26*a*.

An insulator seal 40 is positioned between the spherical outlet surface 38*d* on outlet tip section 38 and the spherical sprue seat 26*b*. Insulator seal 40 is annular and is formed of a composite material including a central aluminum mesh layer 40*a* sandwiched between inner and outer layers 40*b* and 40*c* of heat insulative ceramic material. The insulator face engaging tip surface 38*d* is adhesive backed to securely mount the insulator seal to the tip. Insulator seal 40 is flexible so as to readily conform to the spherically rounded annular tip surface 38*d*.

Heating means 30 includes a heater unit 42 wrapped around nozzle main body section 34; a separate heater unit 44 wrapped around nozzle inlet section 36; and a further separate heater unit 46 wrapped around nozzle outlet tip section 38.

Heater unit 42 includes two band type electrical resistance heaters 48 and 50 arranged end to end and wrapped around main body nozzle section 34; an insulating blanket 52 wrapped around band heaters 48, 50; and a metal clamp cover 54 wrapped around blanket 52.

Band heaters 48, 50 may, for example, comprise MI heaters available from Watlow Corporation of St. Louis, Mo. Each heater includes a main body carrier layer 48*a*, 50*a* totally encapsulating a heating element 48*b*, 50*b* wound in serpentine fashion circumferentially around and axially along the heater. Screw clamps 48*c*, 50*c* allow bands 48, 50 to be wrapped tightly and clampingly around main body nozzle section 34.

Blanket 52 may comprise an alumina-silica ceramic fiber blanket available from AP Green Refractories Company of Mexico, Mo., under the trade name Inswool. Metal clamp cover 54 is wrapped around blanket 52 and is tightened by screws 56 to clampingly secure the band heaters and the blanket around nozzle section 34.

Heater unit 44 includes a band heater 58, such as a Watlow MI band heater, clampingly secured around nozzle inlet tip section 36 and including a heating element 59; an insulating blanket 60, such as Inswool, wrapped around band heater 58; and a metal cover clamp 62 wrapped around blanket 60 and tightened by a screw 64 to clampingly secure heater 58 and blanket 60 around nozzle outlet tip section 36.

Heater unit 46 includes a band heater 66, such as a Watlow MI band heater, clampingly secured around nozzle outlet tip section 38 and including a heating element 67; an insulating blanket 68, such as Inswool, wrapped around band heater 66; and a metal cover clamp 70 wrapped around blanket 68 and tightened by screw 72 to clampingly secure heater 66 and blanket 68 around nozzle outlet tip section 38.

Closed loop controller 32 is connected by a cable 74 to an appropriate source of electricity and operates to selectively energize heater units 42, 44, and 46 in response to separate nozzle body temperature signals from each nozzle section and thereby maintain predetermined or set point nozzle body temperatures in each nozzle section as determined by the individual settings of temperature dials 76, 78, and 80 respectively associated with nozzle sections 38, 34, and 36. Controllers of this general type are commercially available. A plug 82 connects the output of controller 32 with an output cable 84. Output cable 84 includes a double wire 86 connecting electrically at 88 to the heating element 67 of band heater 66; wires 90 and 92 connecting electrically at 94 and 96 to the heating elements 48*a* and 50*a* of band heaters 48 and 50 and arranged to place elements 48*a*, 50*a* in parallel; a double wire 98 connecting electrically at 100 to the heating element 59 of band heater 58; a double wire 102 connecting electrically to a thermocouple 104 having a radially inwardly extending probe 104*a* positioned beneath band heater 66 so as to sense the body temperature of nozzle outlet tip section 38 adjacent bore 38*a*; a double wire 106 connecting electrically to a thermocouple 108 having a probe 108*a* extending radially into nozzle main body section 34 between band heaters 48 and 50 so as to sense the body temperature of nozzle main body section 34 adjacent bore 34*a*; and a double wire 110 connecting electrically to a thermocouple 112 having a radially inwardly extending probe 112*a* positioned beneath band heater 58 so as to sense the body temperature of nozzle inlet tip section 36 adjacent bore 36*a*.

In operation, with the invention nozzle assembly interposed between the standard gooseneck apparatus and sprue bushing 26, temperature dials 76, 78, 80 of control with 32 are set at the particular nozzle body temperatures deemed optimum for the particular casting operation being performed. Controller 32, in response to the nozzle body section temperature signals generated by thermocouples 104, 108, and 112, selectively and separately energizes heater units 46, 42, 44 to respectively maintain the set point nozzle body temperatures in nozzle sections 38, 34, and 36.

The invention nozzle assembly, with its unique ability to separately and individually control the body temperatures in the three distinct sections of the nozzle assembly, has been found to be extremely effective in providing a smooth continuous molten flow of metal from the gooseneck to the die casting machine under a wide variety of operating conditions. The set point temperatures in the nozzle inlet section, the main body section, and the nozzle outlet section typically will be different for each die casting operation and, for a given die casting operation, will be different from each other. For example, for a typical die casting operation in which the molten metal enters the inlet nozzle section at 950 degrees F., it has been found effective to maintain the body temperature of the inlet nozzle tip section at 850 degrees F.; maintain the body temperature of the main body nozzle section at 900 degrees F.; and maintain the body temperature of the outlet tip section at 875 degrees F. The main body portion acts as a heat sink because of its high mass and is relatively slow to heat but, once heated, will hold the absorbed heat for a relatively long period of time. The end sections by contrast have relatively low mass, are quick to heat, and retain the heat for relatively shorter periods of time. The multisection nozzle assembly, with its relatively small diameter and small mass end sections and relatively large diameter and large mass central body section, also fits conveniently into the geometry of the typical die casting environment since the small diameter inlet section conveniently mates with the relatively delicate outlet of the furnace and the small diameter outlet tip section conveniently mates with the relatively delicate inlet to the die casting machine while the large mass, large diameter main body section provides the required mass, strength, and heat sink characteristics for the overall unit. The small diameter inlet and outlet tip sections also allow these sections to access the gooseneck outlet and die inlet despite the narrow and restricted areas typically present at these locations.

In actual practice, and for a given die casting operation, the optimal temperatures for each section, considering electrical efficiency and optimum molten metal flow, will be determined over a period of time by experimentally selecting various temperatures for the various sections and noting the results for each set of temperatures. The invention nozzle assembly, with its individual control of the several nozzle sections, has proven in actual usage to provide significant energy conservation as compared to prior art systems. For example, in a typical operational situation, the invention nozzle assembly, after leveling off of the system, has provided power on and power off times which average out at approximately 25 percent power on to 75 percent power off.

Figure 4:
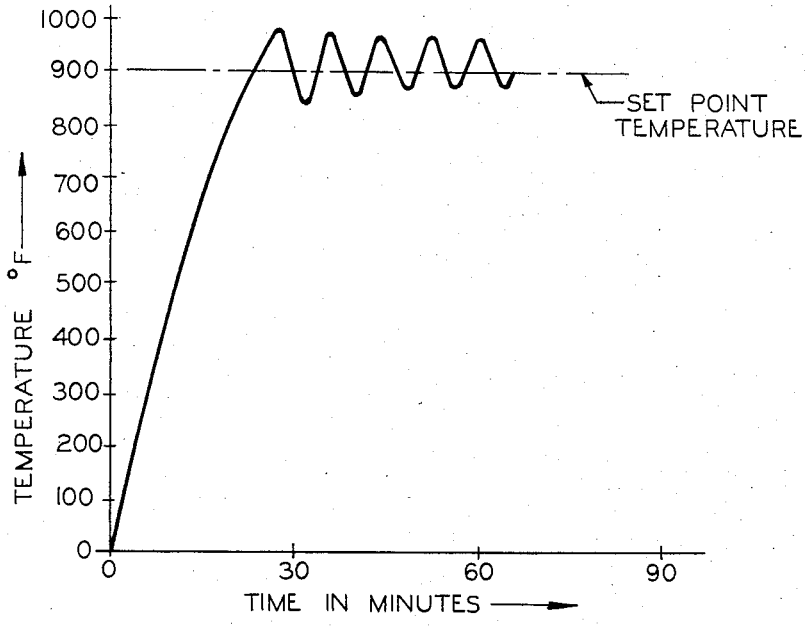
FIG. 4 is a graph of the power cycle curve for a section of the nozzle assembly.

FIG. 4 illustrates the power cycle curve for a main body section 34 having a diameter of 3 inches. As seen in the curve, section 34 took approximately 25 minutes from cold start-up to reach a set point temperature of 900 degrees F., whereafter the control unit functioned to cycle the system on or off each time the temperature of section 34 fell to or rose to the 900 degree set point temperature. It will be seen that, due to system mass and inertia, the section temperature rose significantly further after each shut-off than it fell after each power turn-on so that the total area beneath the 900 degree line and, therefore, the total amount of system "on" time was significantly less than the total area above the 900 degree line, or the total system "off" time, once set point temperature was reached. The system, in fact, averaged two minutes of power on for every six or seven minutes of power off.

The precise temperature control provided by the invention nozzle assembly also optimizes the flow of the molten metal through the nozzle assembly and thereby optimizes the casting process to allow the production of more parts in a given unit of time. The precise control of the nozzle temperature also has the effect of reducing particles and gases in the molten metal with a consequent reduction in the porosity of the castings and increase in the strength and overall quality of the castings.

The precise control of the nozzle temperature also minimizes the tempering of the nozzle that occurs with prior art open flame heating systems and thereby minimizes erosion of the metal lining the bore of the nozzle with a consequent significant increase in the useful life of the nozzle. The invention nozzle assembly, as compared to the prior art open flame, also reduces the risk of nozzle leaks and blow-outs, reduces environmental pollutants, increases productivity, provides easier and faster start ups, reduces costly freeze ups, reduces operational noise, and improves part appearance and quality, and reduces the temperature of the working environment surrounding the nozzle.

The useful life of the nozzle assembly is also increased by the use of the annular insulator seal at the discharge end of the nozzle since this insulator seal, by absorbing the scoring and wear inevitably occuring at the interface of the nozzle and the sprue bushing, eliminates the need to frequently refinish the spherical seating surface at the discharge end of the nozzle and minimizes the need to replace the outlet nozzle tip section because of wear or distortion. The annular insulator seal also provides a simple, effective insulator seal between the nozzle and sprue bushing and reduces the rate of heat transfer from the nozzle to the sprue bushing. The annular seal also minimizes scoring of the spherical seat of the sprue bushing.

In summary, the invention nozzle assembly provides a faster start up time than prior art systems; provides more uniform heating of the entire length of the nozzle assembly; provides increased nozzle assembly life; provides increased heater life; provides improved temperature control with consequent significant improvements in both casting quantity and casting quality; provides significant energy savings; greatly simplifies nozzle repair requirements; reduces or eliminates freeze ups and resultant casting apparatus down time; and provides a safer, healthier and more comfortable environment around the casting apparatus.

Whereas a preferred embodiment of the invention has been illustrated and described in detail it will be understood that various changes may be made in the disclosed embodiment without departing from the scope or spirit of the invention.

The embodiments of the invention in which an exclusive property or privilege is claimed are defined as follows:

1. A nozzle assembly for conducting molten metal from a molten metal source to a die casting mold, said assembly comprising:

A. an elongated relatively large diameter nozzle main body section having an axial through passage adapted to receive molten metal at its inlet end from said source;

B. an elongated relatively small diameter outlet nozzle tip section having a through axial bore coaxial with the through bore in said nozzle main body section;

C. an elongated relatively small diameter inlet nozzle tip section having a through axial bore coaxial with the through bores in said nozzle main body section and said outlet nozzle tip section;

D. a separate heater assembly respectively wrapped around and extending for substantially the entire exposed axial length of said nozzle main body section, said outlet nozzle tip section, and said inlet nozzle tip section; and E. control means operative to separately sense the temperatures of said nozzle main body section, said outlet nozzle tip section, and said inlet nozzle tip section and selectively and separately energize said heater assemblies to separately maintain predetermined set point nozzle body, outlet tip, and inlet tip temperatures.

2. A nozzle assembly according to claim 1 wherein:

F. the outlet end of said outlet nozzle tip section is shaped to provide a spherically rounded annular seating surface around the outlet of the tip bore conforming to the nozzle seating surface at the mold inlet; and G. a flexible annular insulator seal is secured to the outlet end of said outlet tip section and conforms to said spherically rounded annular seating surface to provide an insulator seal between the tip outlet and the mold inlet.

3. A nozzle assembly according to claim 1 wherein:

F. each heater assembly comprises 1. resistance heating means wrapped around the respective nozzle section and extending substantially the entire length of the section, 2. an insulating blanket wrapped around and substantially coextensive with said resistance heating means; and 3. clamping means wrapped around said insulating blanket to maintain the heater assembly in position around the respective nozzle section.

4. A nozzle assembly according to claim 3 wherein:

G. said control means includes a controller and a separate thermocouple associated with each nozzle section and separately connected to said controller to deliver separate temperature signals to said controller corresponding respectively to the sensed temperatures in the three nozzle sections.

5. A nozzle assembly according to claim 4 therein:

H. each thermocouple includes a probe portion extending radially inwardly to a location adjacent the through bore of that section so as to sense the temperature of that section adjacent the molten metal flowing therethrough.

6. A nozzle assembly according to claim 5 wherein:

I. the thermocouples associated with the nozzle tip sections are respectively received beneath the heater assemblies wrapped around those sections;

J. the heater assembly wrapped around said main body section comprises two band heaters arranged end to end with an axial space therebetween; and K. the thermocouple associated with said main body section accesses said main body section in said axial space.

* * * * *